United States Patent [19]

Ward

[11] 4,266,938

[45] May 12, 1981

[54] METHOD OF REMOVING PAINT FROM CLOTH

[76] Inventor: Will A. Ward, 359 W. Bissell, Richmond, Calif. 94801

[21] Appl. No.: 134,938

[22] Filed: Mar. 28, 1980

[51] Int. Cl.[3] ..... B08B 3/04

[52] U.S. Cl. ..... 8/137

[58] Field of Search ..... 8/137; 252/128, 129, 252/130

[56] References Cited

U.S. PATENT DOCUMENTS

| | | | |
|---|---|---|---|
| 1,230,668 | 6/1917 | Casmire | 134/38 |
| 3,106,929 | 10/1963 | Friedrich | 134/38 |
| 3,401,007 | 9/1968 | Hoffman et al. | 8/137 |
| 3,681,251 | 8/1972 | Morrison | 134/38 |
| 3,862,823 | 1/1975 | Green et al. | 8/137 |

*Primary Examiner*—Joseph L. Schofer
*Assistant Examiner*—Maria Parrish Tungol
*Attorney, Agent, or Firm*—Bielen and Peterson

[57] ABSTRACT

A method of removing Latex based paint stains from cloth or clothing which includes the steps of applying water to the stain, applying a mixture of soap and pumice to the area of the water soaked stain, lathering the soap and pumice mixture, and drying the same which induces crystallization of the paint for easy removal of the same.

3 Claims, No Drawings

METHOD OF REMOVING PAINT FROM CLOTH

BACKGROUND OF THE INVENTION

The present invention relates to a novel method of removing a water based paint stain from a cloth object.

Prior art, such as the method found in the U.S. Pat. No. 1,230,668 to Casmire describe mixtures which may be used to remove oil based paint from articles without great damage to the skin of the user as well as the clothing worn by the user. Other formulations have been invented for stripping paints from wood and other solid objects such as those found in U.S. Pat No. 3,106,929 to Friedrich and U.S. Pat. No. 3,681,251 to Morrison.

An early method of cleansing composition was described in U.S. Pat No. 1,452,093 to Pollack, which included the use of sand or pumice in combination with soap and other ingredients.

Recently, water based paints such as acrylic paints, have been replacing oil based paints. Although removal of wet acrylic paint from clothing is a simple matter of washing the article of clothing in water, dried acrylic paints have been almost impossible to remove without destroying cloth itself. A method of removing a water based paint stain, such as acrylic paint, from an article of clothing is needed.

SUMMARY OF THE INVENTION

In accordance with the present invention a novel and useful method of removing water based paint stains from cloth objects is provided.

The method of the present invention includes the step of applying water to the stained portion of the cloth such that water is retained by the cloth in the stained area. Water may be cold water or hot water from the tap. A mixture of soap and pumice material, which may be separate components or formed into a cake, is then applied to both sides of the cloth object at the stained area. Such application of soap pumice must be accomplished while the water is still present in the stain area.

The soap and pumice mixture is then lathered by the application of mechanical energy, i.e. rubbing, brushing, and the like. Finally, the soap and pumice mixture at the stain area is allowed to dry. After drying, the paint forming the stain on the cloth object will loosen its grip on the cloth and flake from the cloth object. The latter process may be aided by the application of mechanical agitation, eg: shaking the cloth object, brushing the stain area of the cloth object, beating the area of the stain on the cloth object, and the like.

It may be apparent that a novel and useful method for removing a water based paint stain from a cloth object has been described.

It is an object of the present invention to provide a method of removing a water based paint stain from a cloth object which employs components readily available in a household.

It is yet another object of the present invention to provide a method of removing a water base paint stain from a cloth object which employs chemical components which are nonvolatile and relatively safe to the user.

It is another object of the present invention to provide a method of removing a water base paint stain from a cloth object which leaves the cloth object undamaged after exercise of the method.

The invention possesses other objects and advantages especially as concerns particular characteristics and features thereof which will become apparent as the specification continues.

DESCRIPTION OF THE PREFERRED EMBODIMENTS

The following examples serve to illustrate the present invention of removing water based paint from a cloth object, but is is not intended that these examples define the limits of the present invention.

EXAMPLE ONE

A stain on a cotton cloth object such as a pair of pants is treated by soaking the same under tap water having a temperature of about 60° centigrade. Water is applied until the stain area is saturated with the same. A mixture of soap and pumice, which may take the form of a cake sold commercially under the trademark "Lava", manufactured by Proctor and Gamble Company, is then applied to the soaked area of the cloth. The soap and pumice mixture is then lathered and left to dry from 24 to 36 hours. After the drying period the paint stain on the cloth is easily removable by shaking.

EXAMPLE TWO

A paint stain on a wool blazer is treated by soaking the stained area in cold tap water having a temperature of about 12° centigrade. Soap and finely divided pumice is applied gently to the stained area and lathered before evaporation of the water. The blazer is allowed to dry for about 48 hours at room temperature. After drying, the soap is gently brushed from the blazer. The above process is repeated if any of the paint stain remains until all the paint has been removed from the blazer.

It has been found that the above method described in examples one and two do not harm the cloth object in any manner. In the case of clothing, the article of clothing may be worn immediately after the final step in each of the examples hereinabove described.

While in the foregoing specification embodiments of the invention have been set forth in considerable detail for the purposes of making a complete disclosure of the invention, it will be apparent to those of ordinary skill in the art that numerous changes may be made in such details without departing from the spirit and principles of the invention.

What is claimed is:

1. A method of removing a water based paint stain which has dried from a cloth object having at least two sides comprising the steps of:

a. applying water to the stained portion of the cloth object to the point of retention of the water by said cloth at the stain area;

b. applying a mixture of soap and pumice material to both sides of the cloth object at the area of the stain while water is retained thereat;

c. lathering said soap and pumice mixture; and d. drying said soap and pumice mixture.

2. The method of claim 1 in which said step of applying water includes the application of water having a temperature range of between 36° centrigrade and 100° centigrade.

3. The method of claim 2 which additionally comprises the step of mechanically agitating said dried soap and pumice mixture from said cloth after said step of drying said soap and pumice mixture.

* * * * *